United States Patent [19]

Tsui

[11] 4,241,716

[45] Dec. 30, 1980

[54] AUTOMATIC TOY GUN FOR PING PONG BALLS

[75] Inventor: Kwok W. Tsui, Hong Kong, Hong Kong

[73] Assignee: Arco Industries Ltd., Hong Kong, Hong Kong

[21] Appl. No.: 11,220

[22] Filed: Feb. 12, 1979

[51] Int. Cl.[3] ..... F41B 7/00

[52] U.S. Cl. ..... 124/27; 124/49; 124/39

[58] Field of Search ..... 124/27, 28, 29, 37, 124/38, 39, 41 R, 50, 49; 273/260

[56] References Cited

U.S. PATENT DOCUMENTS

| | | | |
|---|---|---|---|
| 511,069 | 12/1893 | Brown | 124/39 X |
| 902,771 | 11/1908 | Stange | 124/39 X |
| 1,927,424 | 9/1933 | Trubenbach et al. | 124/39 X |
| 2,371,249 | 3/1945 | Majewski | 124/27 |
| 2,830,569 | 4/1958 | Sakuta et al. | 124/37 UX |
| 2,836,167 | 5/1958 | Saito | 124/27 |
| 3,470,859 | 10/1969 | Ponza | 124/50 X |
| 3,476,100 | 11/1969 | Carbonneau | 124/37 X |

*Primary Examiner*—Richard C. Pinkham
*Assistant Examiner*—William R. Browne
*Attorney, Agent, or Firm*—C. Hercus Just

[57] ABSTRACT

A toy gun simulating an automatic rifle adapted to shoot ping pong balls and comprising a pair of complementary molded hollow shells which are connectable along a central plane to form an elongated frame having a shoulder stock at the rear end, a short cylindrical barrel at the forward end, a stationary supporting handle extending downward from said frame intermediately of the ends thereof, a magazine extending upward and rearward from said barrel to hold a limited number of ping pong balls for discharge into said barrel, a firing ram supported by guide device for reciprocation within the interior of the frame and having a ball-engaging member on the forward end and a head on the rearward end provided with a slot perpendicular to the path of movement of the ram, a crank rotatably supported by one side of said frame and connected to a support rotatable therewith. The support has a crank pin positioned for movement in said slot, and a compression spring within the frame operable upon the firing ram to project the same forwardly to fire a ball from said barrel incident to the crank pin moving from the upper end of said slot in the head of the firing ram prior to the pin reaching its zenith of movement.

3 Claims, 9 Drawing Figures

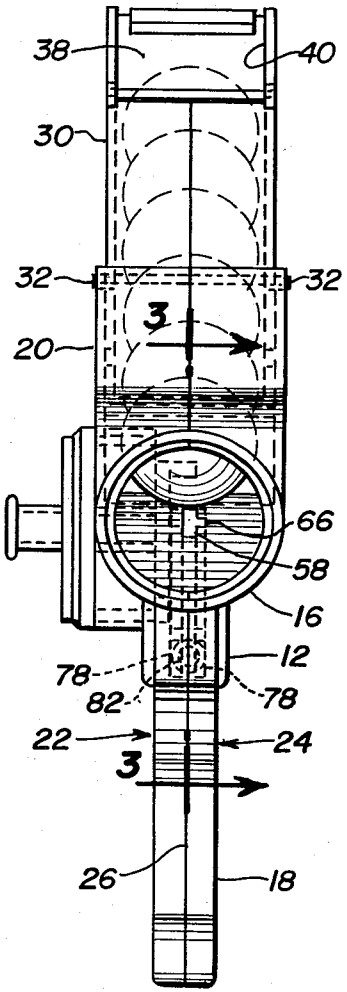
Fig. 2
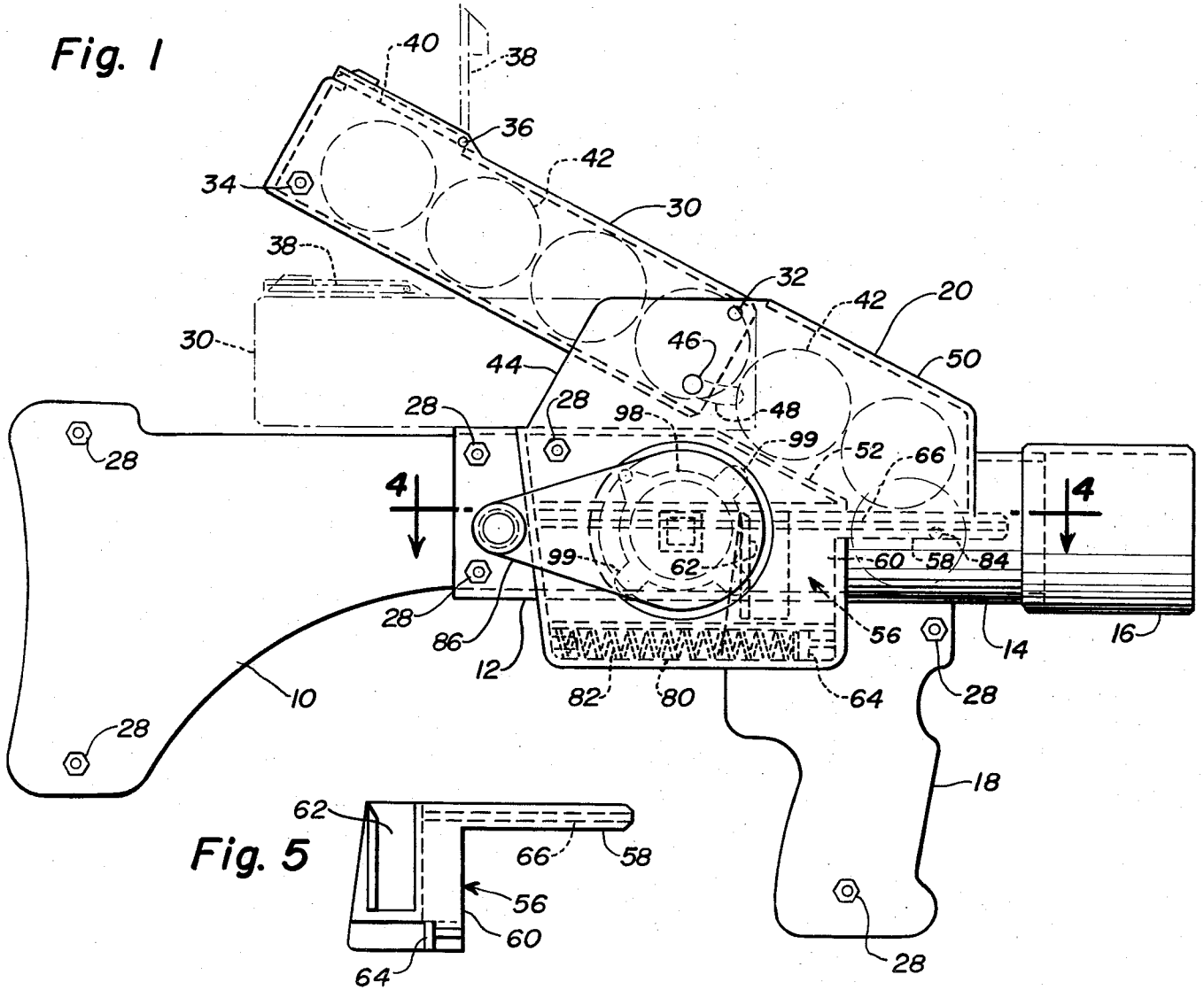
Fig. 1
Fig. 5

AUTOMATIC TOY GUN FOR PING PONG BALLS

BACKGROUND OF THE INVENTION

Toy guns simulating rifles and otherwise have been developed over a long period of time, usually incident to a war occurring. Some of these toy guns have projected marbles or other spherical objects, while still others have projected bullet-simulating projectiles. Still others have projected spherical rubber balls, while in more recent times, especially in an effort to develop harmless toys for children, guns have been devised which shoot ping pong balls or the like. The present invention is directed to this type of projectile.

It also has been quite common heretofore to develop toy guns in which the operation is effected automatically by rotating a crank which operates a firing pin of some type that engages the projectile which is suitably moved into one end of a barrel from a magazine, for example. Certain prior U.S. Patents of this type have included cams which are rotated incident to the crank being revolved, typical examples of these patents being as follows:

U.S. Pat. No. 511,069; Brown; Dec. 19, 1893
U.S. Pat. No. 2,371,249; Majewski; Mar. 13, 1945
U.S. Pat. No. 2,473,272; Blake; June 14, 1949

Still other patents pertaining to guns of the foregoing type have employed star wheels or similar devices which are rotated by a crank for purposes of actuating a firing pin or the like to shoot projectiles from the barrel. Typical examples of prior U.S. Patents of this type are as follows:

U.S. Pat. No. 2,434,436; Rochowiak; Jan. 13, 1948
U.S. Pat. No. 2,836,167; Saito; May 27, 1958
U.S. Pat. No. 3,365,838; Butler et al; Jan. 30, 1968

Still other prior U.S. toy gun patents which are crank actuated form the crank from one wire and the same is unitary with a U-shaped member extending radially from the axis of the crank for engagement with elements connected to the firing pin for purposes of initially retracting the pin and subsequently releasing it for action by a spring to direct the firing pin forwardly and project a pellet or the like from the barrel. Typical prior U.S. examples of toy guns of this type are:

U.S. Pat. No. 1,083,361; Gilson; Jan. 6, 1914
U.S. Pat. No. 2,830,570; Horowitz et al; Apr. 15, 1958

The employment of angularly-arranged magazines in toy guns for automatic feed by gravity of projectiles therefrom into the firing chamber also is disclosed in the following exemplary prior U.S. Patents:

U.S. Pat. No. 1,430,875; Andes; Oct. 3, 1922
U.S. Pat. No. 3,209,741; Yano; Oct. 5, 1965

Although the features described above have been employed in toy guns, it has been found that especially in adapting the manufacture of such guns to the use of plastics which are molded, especially to produce cooperating shells and the like, requires certain revisions and improvements to provide a toy gun which may be manufactured economically and also be durable in use, these features being among the objectives of the present invention as described hereinafter.

SUMMARY OF THE INVENTION

It is among the principal objects of the present invention to manufacture a toy gun simulating a rifle for automatic operation, the gun readily being manufactured by injection molding of plastic materials to produce a pair of complementary shells arranged to be connected in mating relationship along a central plane, the shells when engaged and connected together comprising a simulated stock on the rear end of an elongated frame formed by said shells and having a short cylindrical barrel on the forward end thereof with which the lower end of a downward and forwardly extending magazine communicates to retain and feed ping pong balls from the magazine to the barrel, said frame also including a downwardly extending supporting handle intermediately of the ends thereof, and the interior of the frame supporting a longitudinally slidable firing ram supported by guide means and having a rod-like ball-engaging plunger on the forward end and an actuating head on the rearward end, the actuating head being provided with a slot perpendicular to the path of movement of the head and open at one side to receive a crank pin on a support connected to a rotatable crank, the orbit of the crank pin having a zenith which is above the upper end of said slot, and a compression spring being in engagement with said firing ram to project the same forward after being compressed by rearward movement of the firing ram incident to rotation of one part of the revolution of the crank pin and, when the crank pin nearly reaches its zenith, it passes from the upper end of said slot and permits said compressed spring to instantly project the firing ram forwardly to cause the plunger thereon to engage a ping pong ball in the barrel and shoot it forwardly from said barrel.

It is another object of the invention to form said support upon said crank in the form of a disk upon the periphery of which said crank pin is formed integrally, said disk being rotatable within a suitable complementary cavity in one of the shells comprising the frame and thereby forming a large bearing to rotatably support the crank and the support member thereon upon which the crank pin is mounted.

It is a further object of the invention to provide an articulated type of magazine in which the portion thereof closest to the barrel is integral with the shells comprising the frame, and a supplemental magazine is pivotally connected at its forward end to said integral portion of the magazine so that the supplemental magazine may be moved between an upwardly and rearwardly extending operative position and a depressed, lower position substantially parallel to the frame for compactness.

Details of the foregoing objects and of the invention, as well as other objects thereof, are set forth in the following specification and illustrated in the accompanying drawings comprising a part thereof:

BRIEF DESCRIPTION OF THE DRAWINGS

FIG. 1 is a side elevation illustrating the preferred embodiments of toy guns comprising the present invention and illustrating in full lines, the operative position of the magazine and, in phantom, said magazine is disposed in compact inoperative position.

FIG. 2 is a front elevation of the gun shown in FIG. 1, as seen from the right-hand end thereof.

FIG. 5 is a side elevation of a firing ram included in the gun.

DETAILED DESCRIPTION OF THE PREFERRED EMBODIMENTS

Figure 3:
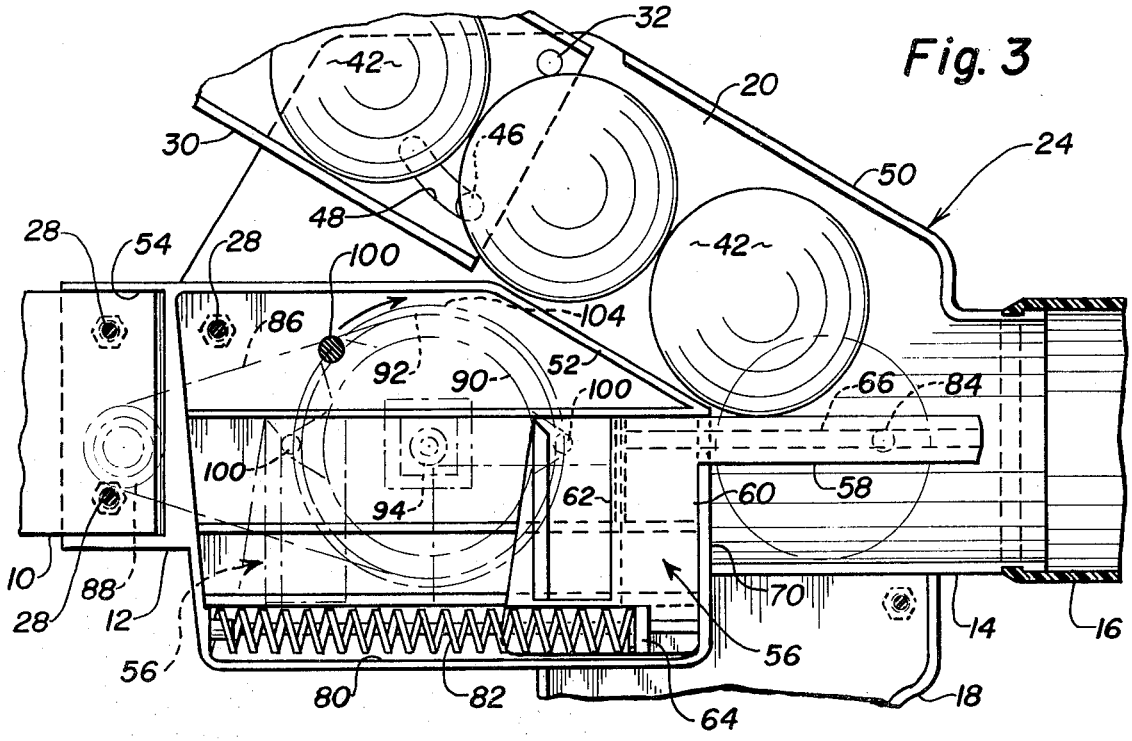
FIG. 3 is a fragmentary vertical sectional view of the central portion of the gun shown in FIGS. 1 and 2, as seen on the line 3—3 of FIG. 2, the scale employed in this figure being larger than that in FIGS. 1 and 2.

Although the prior art illustrates various mechanisms for toy guns operable automatically to shoot or fire projectiles of different types from barrels in the guns, it has been found necessary to devise innovations in the present invention incident to adopting certain mechanical principles of operation but forming the same from plastic materials, such as by injection molding or otherwise, and particularly to devise the components in such manner that the same readily can be assembled expeditiously and with a minimum amount of hand operations. Details of the best mode of construction and manufacture of the preferred embodiment of the guns are set forth hereinafter and are illustrated in the drawings to which reference is made in the following descriptions:

Referring to FIG. 1, it will be seen that the gun of the present invention generally simulates an automatic rifle by providing at one end, a simulated shoulder stock 10 which is at the rear end of a longitudinal frame 12 which, at the front end, which is opposite the end having the stock 10 thereon, is provided with a barrel 14 to which a barrel extension 16 is connected. Intermediately of the opposite ends of the longitudinal frame 12, a hand grip 18 is provided which depends downwardly. The frame 12 also is provided substantially in vertical alignment with the hand grip 18 with a portion 20 of a magazine.

All of the parts of the toy gun referred to above, with the exception of the barrel extension 16, are formed by a pair of shells 22 and 24 which are mirror images of each other and abut each other along a median line 26, shown best in FIG. 2. Said shells may readily be connected after assembly thereinto of internal mechanism described hereinafter. Suitable connecting means 28, shown best in FIG. 1, are provided in the shells and may consist of cooperating, interfitting pins and tubular projections which may be attached by appropriate cement or, if desired, suitable self-tapping screws or nuts and bolts may be used.

A supplemental magazine 30 is pivotally connected by pin means 32 of suitable type to the upper and rearward end of the magazine portion 20. The supplemental magazine 30 may be substantially square in cross-section and also consist of a pair of hollow shells which are mirror images of each other, and are connected together by attaching means 34, as well as a pivot pin 36 which also serves as a pintle for a cover 38 for the inlet opening 40 of the supplemental magazine through which projectiles, such as ping pong balls 42, are introduced to the supplemental magazine and the innermost balls 42 are disposed in the magazine portion 20, which is composed of a pair of parallel side members which have rearward extensions 44 that are spaced apart sufficiently to accommodate the forward end of the supplemental magazine 30, thereby also assisting in maintaining the opposite shells of the magazine in cooperative relationship.

The supplemental magazine 30 is illustrated in full lines in the operative position in FIG. 1 and, in phantom, the same is shown in depressed position in which it is disposed against the upper surface of the longitudinal frame 12 for compactness, especially in regard to storage and shipping. The side shells of the supplemental magazine 30 are provided with short pins 46, which are operable in short arcuate slots or grooves 48 in said shells and are provided for purposes of controlling the elevated position of the supplemental magazine 30. From FIGS. 1 and 3, it also will be seen that the magazine portion 20 is defined by an outer wall 50 and an inner wall 52 which defines a channel suitable to accommodate the ping pong balls 42 for free movement downwardly, by gravity, into the barrel 14, but only under conditions described hereinafter. It will be understood that the inner and outer walls 50 and 52 of the magazine portion 20 are bipartite and respectively comprise portions of the opposite shells 22 and 24, shell 24, for example, being shown in FIG. 3. Further, when the supplemental magazine 30 is in the extended, operative position as shown fragmentarily in FIG. 3, it is in axial alignment with the channel of the magazine portion 20. Also, in FIG. 3, it will be seen that for ease of molding in particular, the shoulder stock 10 may initially be separate from the longitudinal frame 12, as best shown in FIG. 3, and the rear end of the frame 12 may be provided with a socket 54, which receives the forward end of the shoulder stock 10, said forward end being affixed in the socket 54 by cement or any other suitable connecting means.

The cavity defined by the opposite shells 22 and 24 of the longitudinal frame 12 supports on the interior thereof a firing ram 56 which is shown in side elevation in FIG. 5. From FIG. 5, it will be seen that the firing ram 56 includes a rod-like ball-engaging plunger 58 which, in FIG. 3, is shown in full lines in its forward position and, in phantom, in its most retracted position. An actuating head 60 is on the rearward end of the firing ram 56 and is provided with a recess or slot 62, which is open at one side of the head and is perpendicular to the path of movement of the firing ram. A spring abutment 64 projects laterally from the lower portion of the firing ram for engagement by a compressing spring described hereinafter. On the side opposite that shown in FIG. 5, the ball-engaging plunger 58 also is provided with a longitudinal guide rib 66.

The shell 24 is provided on the interior thereof with a pair of parallel walls 68 and 70, which are perpendicular to the outer wall of said shell and the innermost edges thereof are provided with notches 72, which receive the guide rib 66 on the plunger 58 of the firing ram 56. Similarly, the shell 22 is provided with a cooperating pair of parallel walls 74 and 76, the innermost edges of which are slidably engaged by the plunger 58 to guide and position the same so that the outer end thereof is substantially central with respect to the barrel 14, as best shown in FIGS. 3 and 4.

Figure 4:
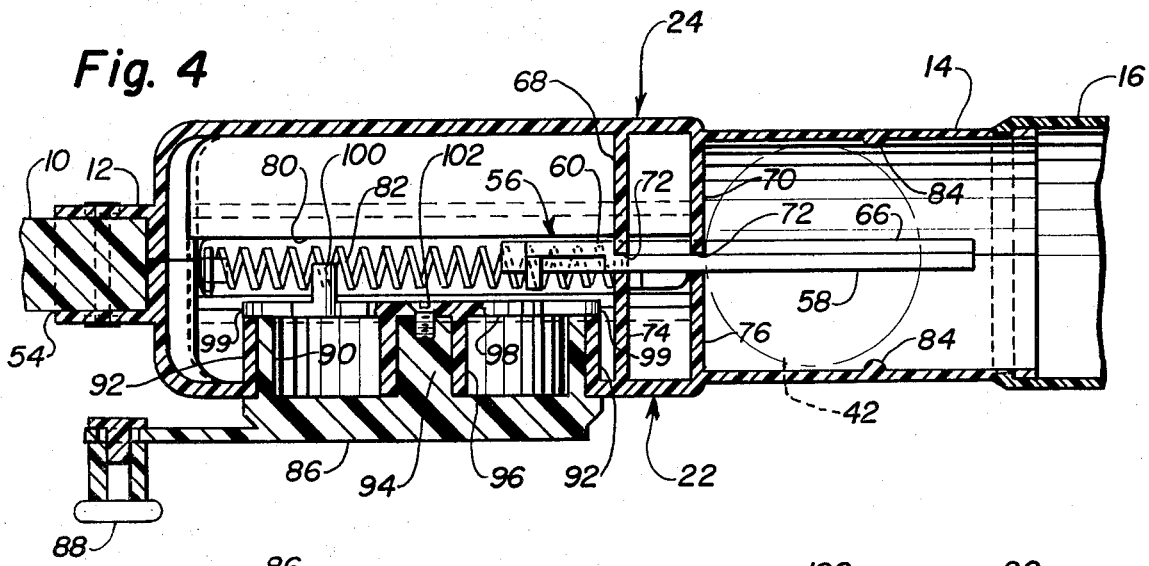
FIG. 4 is a fragmentary horizontal sectional view of the portion of the gun shown in FIG. 3, as seen on the line 4—4 of FIG. 1.

Referring to FIGS. 1, 3 and 4 in particular, it will be seen that the lower portion of the longitudinal frame 12 is narrower than the mid-portion thereof from which the barrel 14 projects, and the inner surfaces 78 thereof, best shown in FIG. 2, define a longitudinal recess 80 within which a compression spring 82 is contained, one end of the spring abutting the rear wall of the frame 12, as shown in FIGS. 1 and 3, and the forward end thereof engaging spring abutment 64 on the firing ram 56. The spring 82 is of such power that it is capable of being compressed an appreciable amount during rearward movement of the firing ram 56 by means described hereinafter and, when released, at the end of said rearward movement, the spring sharply projects the firing ram forwardly so that the plunger 58 engages a ball which has been lowered into the barrel 14 and shoots it from the barrel and the barrel extension 16. As shown in FIGS. 1 and 3, the normal forward position of the firing ram 56 is such that the plunger 58 blocks movement of the lowermost ball 42 in the magazine portion 20, but when retracted, the outer end of the plunger 58 is substantially even with the wall 70 so that a ball may drop from the magazine portion 20 into the barrel 14, but the ball may not drop or roll from the barrel until next engaged by the plunger 58, due to the provision of restraining means 84, best shown in FIGS. 3 and 4, which preferably may comprise short rounded projections and the distance therebetween is only slightly less than the diameter of the ball 42 so that the force of the firing ram is capable of pushing the balls past said restraining means incident to firing the same.

Actuation of the firing ram 56 is effected by means of a crank 86 which has a finger-engaging knob 88 on the outer end thereof, said crank being connected to a cylindrical support 90, which is rotatably fitted within a cylindrical wall 92, which extends inward from shell 22 as clearly shown in FIG. 4. The crank 86 and the support 90 have a central stud 94 projecting inwardly therefrom for positioning within a socket member 96, which is complementary to the cross-sectional shape of the stud 94. As shown in FIG. 3, the cross-sectional configuration is of a geometrical type, such as a square, and the socket member 96 is integral with one face of a disc 98 with which the socket member 96 is substantially central. Projecting from the opposite face of the disk 98 is a crank pin 100 which is engageable with the recess or slot 62, especially the rearward wall thereof. The disk 98 also is provided with opposed ears 99 which at the tips thereof engage the inner rim of the cylindrical wall 92 slidably to secure the crank 86 against removal from the wall 92 by which the crank is supported therein by cylindrical support 90.

From FIG. 3, as well as FIGS. 6–9, it will be seen that the crank 86 preferably is rotated clockwise. Also, the upper end of the recess or slot 62 is only a short distance above the axis of the disk 98, which is secured to the stud 94 by a screw 102. Accordingly, the circular path described by the crank pin 100 during rotation of the crank 86 has a zenith 104, see FIG. 3, which is above the upper end of the recess or slot 62 for the following purpose.

Figure 6:
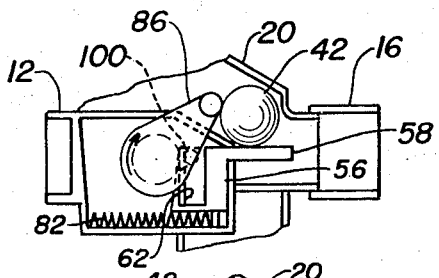
FIGS. 6–9 are fragmentary, diagrammatic figures, respectively illustrating successive positions of the firing mechanism of the gun, which is operable not only to shoot projectiles from the barrel, but also to retain the projectiles in the magazine from entering the barrel until the firing mechanism is in retracted position.
Figure 8:
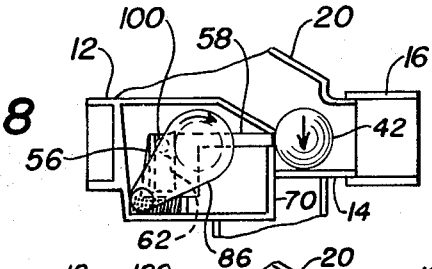
Figure 7:
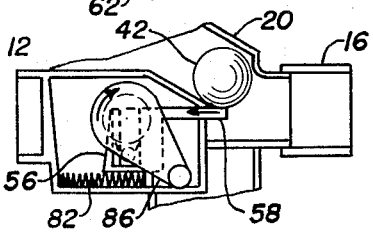
Figure 9:
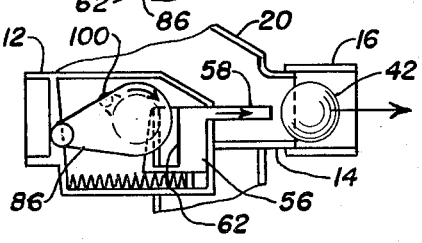

Referring particularly to FIGS. 6–9, it will be seen from FIG. 6 that when the crank 86 is in the position shown therein, the crank pin 100 is entering the upper end of the vertical slot or recess 62. Continued movement, as illustrated in FIG. 7, retracts the firing ram 56 and in so doing compresses the spring 82. In FIG. 8, the crank pin 100 is approaching the upper end of the recess or slot 62 and it also will be seen that the plunger 58 has been fully retracted to permit a ball 42 to drop into the barrel 14 from the magazine portion 20. When rotation of the crank through an additional few degrees occurs from the position shown in FIG. 8, as illustrated in FIG. 9, the crank pin 100 has been completely removed from the recess or slot 62 and is approaching its zenith of movement but, due to the release of the firing ram 56 from the crank pin 100, the spring 82 sharply projects the firing ram forwardly to cause the plunger 58 thereof to shoot the ball 42 from the barrel and barrel extension 14 and 16. When in said forward position, the firing ram 56 is so positioned that the recess or slot 62 thereof is in position to have the crank pin 100 reenter the upper end of the same during continued clockwise movement of crank 86, and thereby reestablish the cycle commencing with the positions shown in FIG. 6, as described above.

It will be seen from the foregoing that the gun may be operated continuously by repeated revolutions of the crank 86, and in sequence, the plunger 58 is retracted to permit a ball from the magazine portion 20 to drop into the barrel 14, and subsequently, the ball 42 in barrel 14 is shot therefrom until the supply of balls in the magazine is exhausted. The magazine is readily replenished through opening 40 and further operation of the gun then may be resumed.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A toy gun simulating an automatic rifle adapted to shoot ping pong balls comprising in combination, an elongated frame comprising a pair of rigid molded complementary hollow shells which when connected along a common central plane define respectively: a shoulder stock at the rear end, a short cylindrical barrel at the forward end, a stationary supporting handle extending downward from said frame intermediately of the ends thereof, a portion of a magazine extending upward and rearward from said frame at an acute angle adjacent the rearward end of said barrel, the interior of said magazine being shaped and adapted to hold and control movement of a row of a limited number of ping pong balls, and means to secure said shells in mating relationship to define a hollow interior, the improvements comprising means pivotally connecting a supplemental magazine to said portion of a magazine in said frame adjacent the rearward end of said barrel to permit movement of said supplemental magazine between a depressed inoperative position substantially parallel to said frame and an elevated position in which it extends upward and rearward from said magazine portion and in axial alignment therewith, a firing ram supported by guide means for reciprocation within the interior of said frame and having a rod-like ball-engaging plunger on the forward end movable longitudinally in said frame between a retracted position and an extended firing position beneath said magazine portion of said frame and into said barrel and an actuating head on the rearward end of said firing ram provided with a straight slot perpendicular to the path of movement of said ram open at one side of said head, a crank rotatably supported by one side of said frame by a short cylindrical support extending from said crank and rotatable within a complementary cylindrical flange bearing wall extending laterally into the interior of said frame from one of said hollow shells thereof and integral therewith adjacent said head of said ram, a crank pin projecting laterally from an inner face of a disc on said cylindrical support and integral therewith and positioned within said slot in said head of said ram, said disc being fixed to the inner face of said short cylindrical support and overlying the rim of said bearing wall to retain said support operatively within said flange bearing, and a compression spring mounted within said frame and extending between a rearward wall in the interior of said frame and the lower portion of a forward part of said head on said ram and operable to be compressed when said ram is moved rearwardly by rotation of said crank and engagement of said crank pin with the rear wall of said slot and operable to project said ram forwardly when said crank pin is moved out of said slot incident to rotation of said crank, the upper end of said slot being below the upper zenith of rotational movement of said crank pin, whereby said slot is freed from said crank pin prior to said pin reaching said zenith of its movement.

2. The toy gun according to claim 1 in which said cylindrical support has a central stud fitting into a socket projecting centrally from said disk for said crank pin, said socket projecting from the opposite surface of said disk from that to which the crank pin is attached.

3. A toy gun simulating an automatic rifle adapted to shoot ping pong balls comprising in combination, an elongated frame comprising a pair of rigid molded complementary hollow shells which when connected along a common central plane define respectively: a shoulder stock at the rear end, a short cylindrical barrel at the forward end, a stationary supporting handle extending downward from said frame intermediately of the ends thereof and a magazine above said barrel shaped and adapted to hold and direct movement of a row of a limited number of ping pong balls, and means to secure said shells in mating relationship to define a hollow interior; the improvements comprising a firing ram supported by guide means within said shells for reciprocation within the interior of said frame and having a rod-like ball-engaging plunger on the forward end movable longitudinally in said frame between a retracted position and an extended firing position beneath said magazine and into said barrel and an actuating head on the rearward end of said firing ram provided with a straight slot perpendicular to the path of movement of said ram open at one side of said head, a crank rotatably supported by one side of said frame by a short cylindrical support extending from said crank and rotatable within a complementary cylindrical flange bearing wall extending laterally into the interior of said frame from one of said hollow shells thereof and integral therewith adjacent said head of said ram, a crank pin projecting laterally from an inner face of a disc on said cylindrical support and integral therewith and positioned within said slot in said head of said ram, said disc being fixed to the inner face of said short cylindrical support and overlying the rim of said bearing wall to retain said support operatively within said flange bearing, and a compression spring mounted within said frame and extending between a rearward wall in the interior of said frame and the lower portion of a forward part of said head on said ram and operable to be compressed when said ram is moved rearwardly by rotation of said crank and engagement of said crank pin with the rear wall of said slot and operable to project said ram forwardly when said crank pin is moved out of said slot incident to rotation of said crank, the upper end of said slot being below the upper zenith of rotational movement of said crank pin, whereby said slot is freed from said crank pin prior to said pin reaching said zenith of its movement.

* * * * *